US006591812B2

(12) United States Patent
Augustin

(10) Patent No.: US 6,591,812 B2
(45) Date of Patent: Jul. 15, 2003

(54) RAIL CONNECTION WITH RATE SHAPING BEHAVIOR FOR A HYDRAULICALLY ACTUATED FUEL INJECTOR

(75) Inventor: Ulrich Augustin, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 0 days.

(21) Appl. No.: 10/012,415

(22) Filed: Dec. 12, 2001

(65) Prior Publication Data

US 2002/0073969 A1 Jun. 20, 2002

Related U.S. Application Data

(60) Provisional application No. 60/255,142, filed on Dec. 14, 2000.

(51) Int. Cl.[7] ..... F02M 37/04

(52) U.S. Cl. ..... 123/456; 123/496; 123/299; 123/467

(58) Field of Search ..... 123/456, 467, 123/496, 299–300; 137/513.3

(56) References Cited

U.S. PATENT DOCUMENTS 4,628,957 A * 12/1986 Hofer et al. ..... 123/467
5,511,528 A * 4/1996 Iwanaga et al. ..... 123/467
5,752,486 A * 5/1998 Nakashima et al. ..... 123/467
5,842,452 A * 12/1998 Pattanaik ..... 123/467
6,189,508 B1 * 2/2001 Stan ..... 123/467
6,205,978 B1 * 3/2001 Zoeller ..... 123/456
6,467,457 B1 * 10/2002 Lei et al. ..... 123/456

* cited by examiner

*Primary Examiner*—Thomas N. Moulis
(74) *Attorney, Agent, or Firm*—McGuireWoods LLP

(57) ABSTRACT

A rail connection assembly includes an outer rail connection tube having a rail connection outlet, a component having a substantially centrally located bore that is fixed to the outer rail connection tube remote from said rail connection outlet, and a piston adapted for movement between a first position and a second position, with the second position being remote from said bore. A nipple having a predetermined cross section and extends from the piston and is slidably movable into and remote from said bore when the piston is moved between the first and second positions, respectively. A fluid communication path exists between the bore and the rail connection outlet. This provides a pilot injection of fuel when the piston moves into an intermediate position between the first and second positions and a full injection of fuel when the piston reaches the second position.

31 Claims, 7 Drawing Sheets

RAIL CONNECTION WITH RATE SHAPING BEHAVIOR FOR A HYDRAULICALLY ACTUATED FUEL INJECTOR

This application claims priority under 35 U.S.C. §§119 (e) and 120 of U.S. Provisional Patent Application Serial No. 60/255,142, filed Dec. 14, 2000.

DESCRIPTION

BACKGROUND OF THE INVENTION

1. Field of the Invention

The present invention generally relates to an oil activated fuel injector. More particularly, the present invention relates to a rail connection with rate shaping behavior for an oil activated electronically or mechanically controlled fuel injector.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or another type of suitable hydraulic fluid that is provided to the fuel injector via a rail connection system. The working fluid, once provided to the fuel injector, is capable of providing a pressure within the fuel injector in order to begin the process of injecting fuel into the combustion chamber.

However, in current connection rail designs, a large amount of working fluid is initially permitted to flow into the inlet area of the fuel injector. This large volume of initial working fluid causes bouncing effects of the injector valve of the fuel injector. Also, a small quantity (pilot injection) of fuel cannot be efficiently injected into the engine during a pre-stroke phase of the plunger due to the fact that a large quantity of working fluid is initially allowed to flow into the inlet area of the fuel injector. These shortcomings lead to higher emissions and engine noise.

In presently known designs, to provide a smaller quantity of fuel to the combustion chamber of the engine a delay of the pre-stroke of the plunger must be provided. However, this can only be provided in the conventional system by adding more working fluid, under high pressure, into the injector. The additional pressurized working fluid may cause a delay; however, additional energy from the high pressure oil pump must be expanded in order to provide this additional working fluid. This leads to an inefficiency in the operations of the fuel injector itself, and also does not provide a consistent supply of fuel into the engine.

The present invention is directed to overcoming one or more of the problems as set forth above.

SUMMARY OF THE INVENTION

It is an object of the present invention to provide a fuel injector with improved efficiency.

It is another object of the present invention to provide a rail connector assembly that provides a pilot injection of fuel without the need to expend additional energy at the oil pump.

It is still another object of the present invention to provide a fuel injector that minimizes a bounce effect of a control body.

According to one aspect of the invention, a rail connection assembly generally includes an outer rail connection tube having a rail connection outlet and a component having a substantially centrally located bore, said component being fixed to said outer rail connection tube remote from said rail connection outlet. A piston adapted for movement between a first position and a second position, with the second position being remote from the bore, is also provided. A nipple with a predetermined cross-section extends from the piston and is slidably movable into and remote from the bore as the piston is moved between the first and second positions. A fluid communication path exists between the bore and the rail connection outlet.

In embodiments, a plurality of lateral grooves are formed in either the component or the outer rail connection tube to provide the fluid communication path between the bore and the rail connection outlet. An annular groove may also be formed in either the component or the outer rail connection tube to provide fluid communication between the bore and the rail connection outlet. The piston may also include a bore disposed proximate said nipple for providing a further fluid communication path. A spring disposed within the piston and resting on a spring seat, which may be provided either on the piston or the outer rail connection tube, tends to bias the piston towards the first position, and therefore provides a restoration force when the piston is moved into the second position.

According to another aspect of the invention, a pressurized working fluid is allowed to flow into the rail connection assembly. This tends to bias the piston downwards, opening a gap within the rail connection assembly. The first amount of working fluid passes through the gap and into an inlet on a fuel injector, thereby triggering a pilot injection of fuel. As additional working fluid is introduced, the piston is fully biased into the second position, which opens a larger second gap. A full amount of working fluid is then allowed to pass into the inlet triggering a main injection.

BRIEF DESCRIPTION OF THE DRAWINGS

The foregoing and other objects, aspects, and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an oil rail connection used with an oil activated, electronically, mechanically, or hydraulically controlled fuel injector. The rail connection is capable of eliminating bouncing effects of an injector valve as well as providing rate shaping. The rail connection is also designed to allow the fuel injector to inject small quantities of fuel from the fuel injector into a combustion chamber of an internal combustion engine (pilot injection). With this connection mechanism an increase in efficiency of the injection cycle can be realized in an oil activated fuel injector.

Embodiments of the Oil Activated Fuel Injector of the Present Invention

Figure 1:
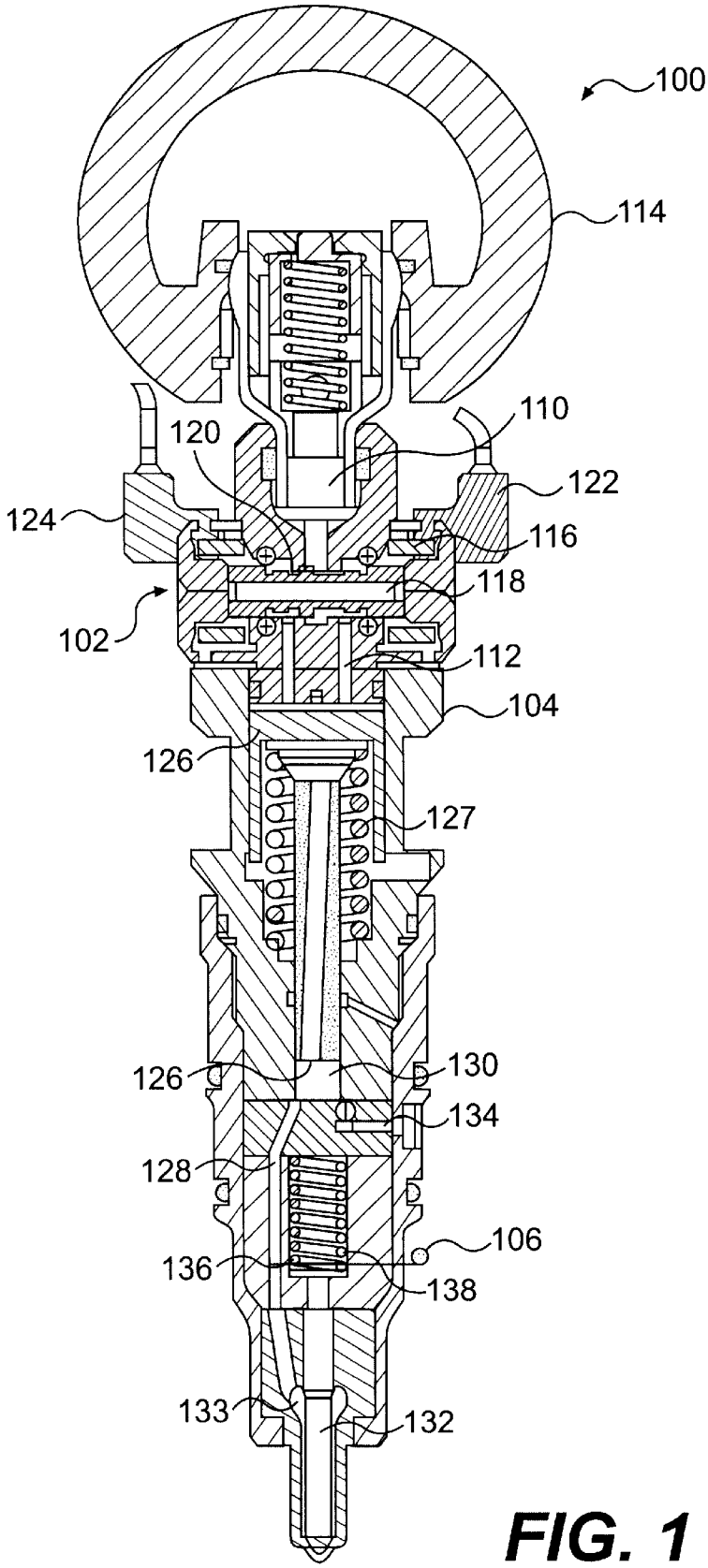
FIG. 1 shows a rail connection of the present invention used with an oil activated fuel injector.

Referring now to FIG. 1, an exemplary embodiment of a fuel injector used with the rail connection of the present invention is shown. The fuel injector depicted in FIG. 1 is provided for illustrative purposes only. It should thus be well understood by those of ordinary skill in the art that any known fuel injector may be modified to be used with the rail connection of the present invention.

The fuel injector of FIG. 1 is generally depicted as reference numeral 100 and includes a control valve body 102 as well as an intensifier body 104 and a nozzle 106. In general, the control body 102 includes an inlet area 110 in fluid communication with working ports 112 and a rail connection 114. The rail connection 114 provides working fluid to the fuel injector 100 via the inlet area 110. At least one groove or orifice (hereinafter referred to as grooves) 116 are positioned between and in fluid communication with the inlet area 110 and the working ports 112. A spool 118 having at least one groove or orifice (hereinafter referred to as grooves) 120 is slidably mounted within the control valve body 102. An open coil 122 and a closed coil 124 are positioned on opposing sides of the spool 118 and are energized via a driver (not shown) to drive the spool 118 between a closed position and an open position. In the open position, the grooves 120 are aligned with the grooves 116, thus allowing the working fluid to flow between the inlet area 110 and the working ports 112 of the valve control body 102.

Still referring to FIG. 1, the intensifier body 104 is mounted to the valve control body 102 via any conventional mounting mechanism. A seal (e.g., o-ring) may be positioned between the mounting surfaces of the intensifier body 104 and the valve control body 102. A combination piston and plunger assembly 126, including an intensifier spring 127, is positioned within the intensifier body 104. The intensifier spring 127, in embodiments, surrounds a portion (e.g., shaft) of the plunger and is further positioned between the piston and a flange or shoulder formed on an interior portion of the intensifier body. The intensifier spring 127 urges the piston and plunger assembly 126 in a first position proximate to the valve control body 102.

The exemplary fuel injector of FIG. 1 also includes a longitudinal bore 128 which extends between a high pressure chamber 130, positioned below the piston and plunger assembly 126, and a needle 132 positioned within the nozzle 106. A chamber 133 surrounds the needle 132. A check valve assembly 134 is also in fluid communication with the high pressure chamber 130. A spring assembly 136 is in biasing communication with the needle 132. The spring assembly 136 is preferably positioned within a spring cage 138.

Figure 2:
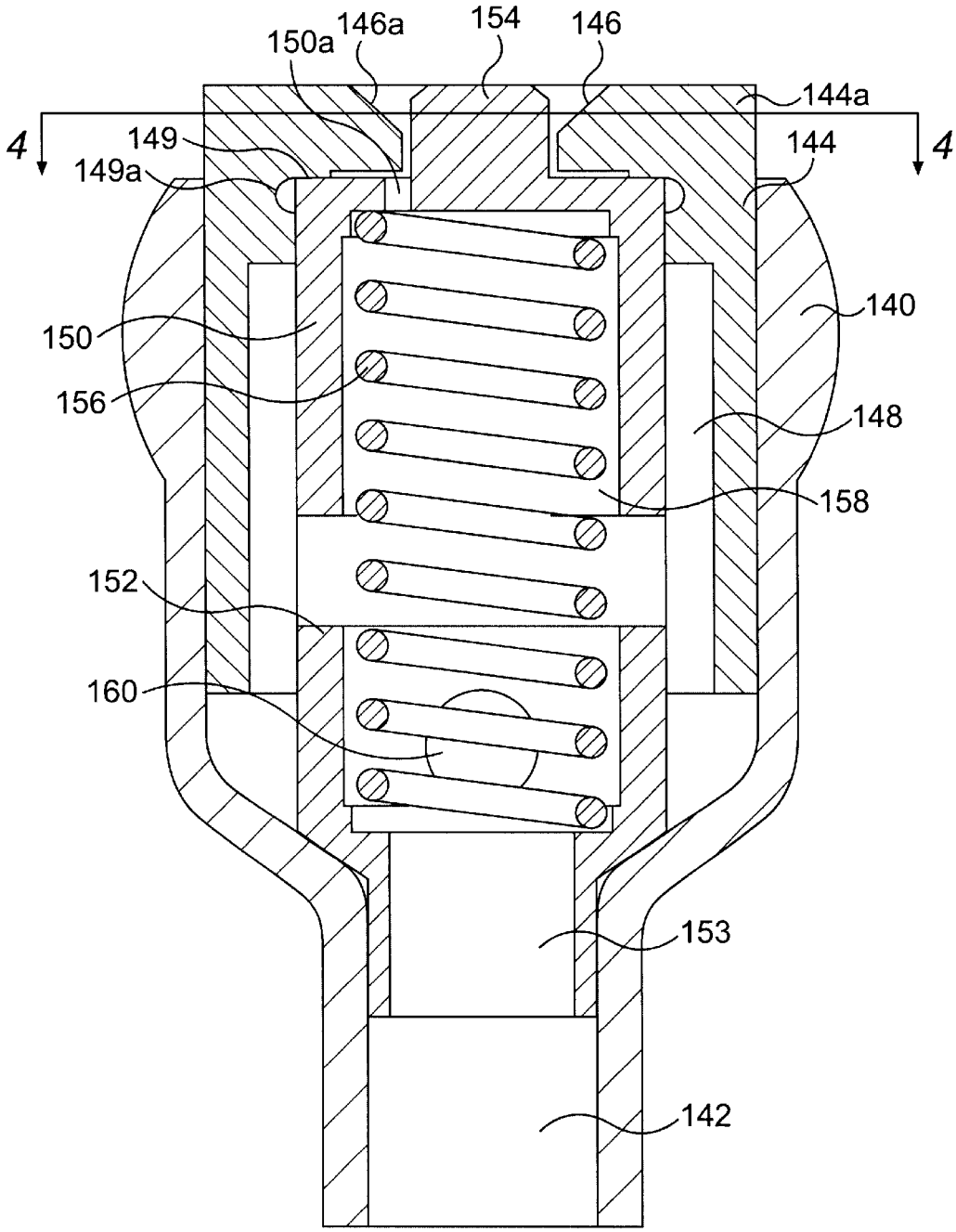
FIG. 2 shows a cross sectional view of the rail connection of the present invention.
Figure 3A:
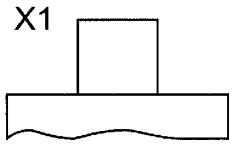
FIGS. 3*a*–3*d* show different nipple configurations used with the rail connection of the present invention.
Figure 3B:
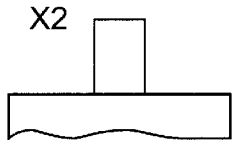
Figure 3C:
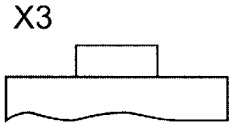
Figure 3D:
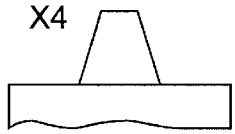

FIG. 2 shows a cross sectional view of the rail connection of the present invention. The rail connection includes at outer rail connection tube 140 having a rail connection outlet 142. The rail connection outlet 142, in embodiments, is in fluid communication with the inlet area 110 of the control valve body 102. A centrally located barrel section 144 is positioned within the outer rail connection tube 140, and in embodiments, includes a portion 144*a* extending therefrom. The extending portion 144*a* of the barrel section 144 includes a centrally located bore 146 having, in embodiments, flared portions 146*a*. It should be noted that differently shaped centrally located bores may also be used with the present invention. Lateral grooves 148 are provided on an interior wall surface of the barrel section 144. In the preferred embodiment, four lateral grooves 148 are evenly spaced about the interior perimeter (i.e., circumference) of barrel section 144; however, more or less than the four preferred lateral grooves are also contemplated for use with the present invention. The grooves 148 provide a fluid path for the oil, via the rail connection, to the inlet area 110 of the control body 102.

FIG. 2 further shows an upper stop 149, which, in embodiments, is formed on the upper interior portion of the barrel section 144, proximate the centrally located bore 146. The upper stop 149 may include an annular groove 149*a* which provides a space between a piston 150 provided partially in the barrel section 144 and the outer rail connection tube 140 and the barrel section 144. The piston 150 includes a spring seat 152 as well as a downward extending portion 153, which may extend into the rail connection outlet 142. A nipple 154 extends from the piston 150, remote from the spring seat 152. In the preferred embodiment of the present invention, the nipple 154 is slidable to seat within the centrally located bore 146 of the barrel section 144, and may include several different shapes and cross sections such as those shown in FIGS. 3*a*–3*d*. The piston 150 may also include a bore 150*a* located proximate the nipple 154. Like grooves 148, bore 150*a* is in fluid communication with inlet area 110. A spring 156 is positioned within a bore 158 of the piston 150, and is more particularly positioned below the nipple 154 and resting on the spring seat 152. The piston 150 is urged or biased upwards towards the nipple 154 by the spring 156 to rest against the upper stop 149 of the barrel section 144. The nipple 154 of the piston 150 is preferably in the center of the barrel bore 158. To provide an oil flow from the grooves 148 to the rail connection outlet 142 there are several holes 160, preferably four holes, in the spring seat 152.

Figure 4:
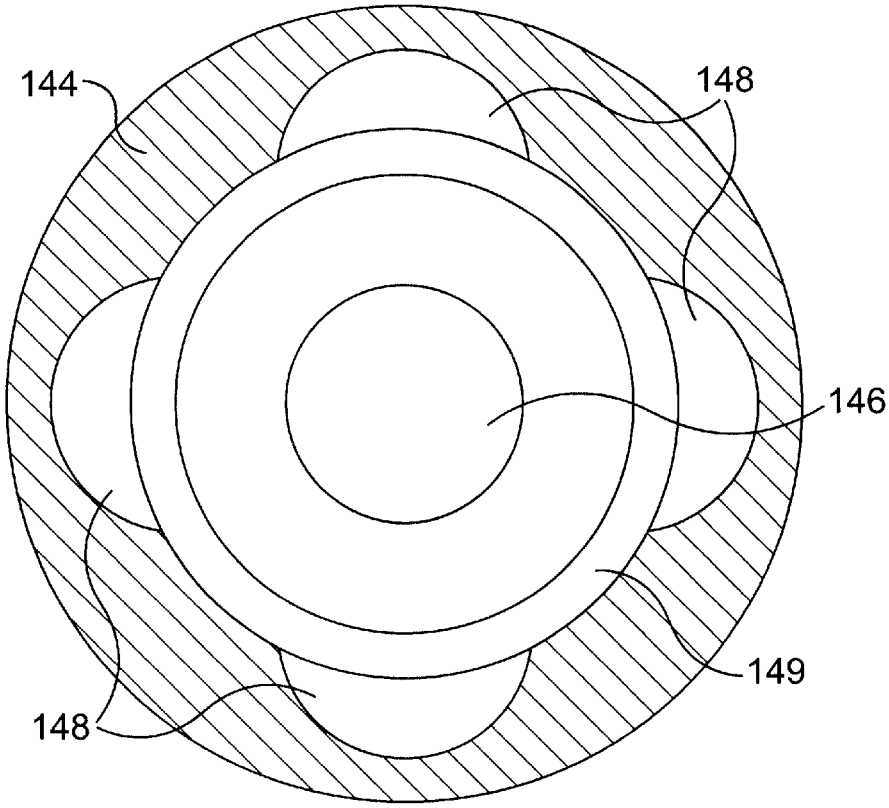
FIG. 4 is a top view of the rail connector along line 4—4 of FIG. 2.

FIG. 4 is a top view of the rail connector along line 4—4 of FIG. 2. In this figure, there are four lateral grooves 148, which are shown to be semi-circular and surrounding the central bore 146 of the barrel section 144. However, it should be understood that different shapes and configurations of the lateral grooves 148 are contemplated in embodiments. The upper stop 149 is shown to be circumferentially positioned about the barrel section 144.

Figure 5:
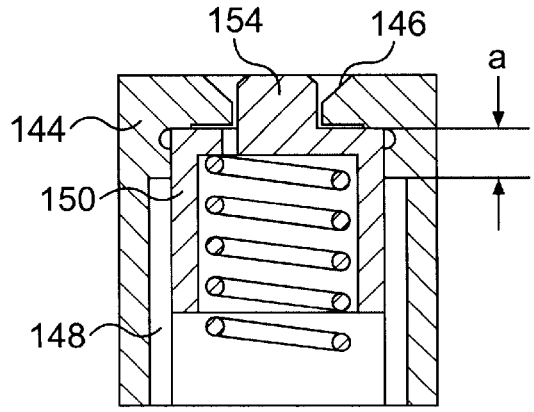
FIGS. 5 through 8 show the several positions of the piston of the rail connection during an injection cycle.
Figure 6:
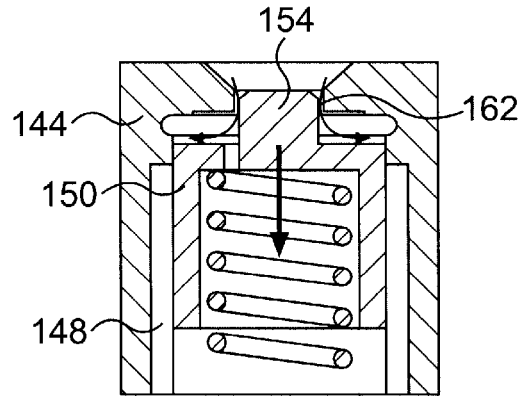
Figure 7:
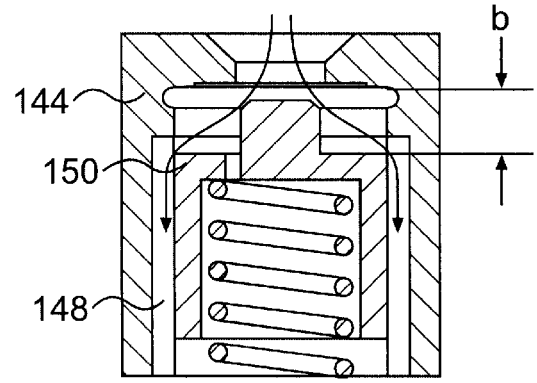
Figure 8:
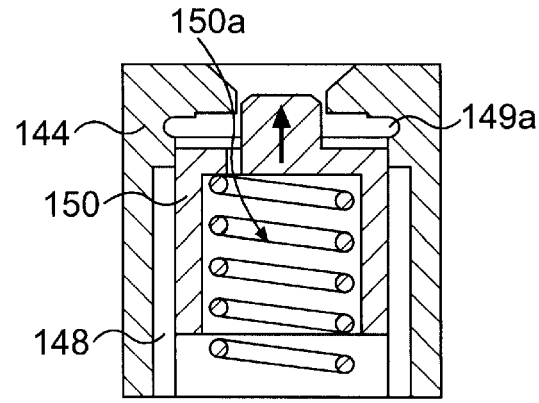

FIGS. 5 through 8 show the several positions of the piston of the rail connection during an injection cycle. FIG. 5 shows the rail connection prior to an injection cycle, i.e., in a closed position that does not allow oil to flow into the inlet area of the fuel injector. To start an injection cycle, an injector valve opens and high pressure oil begins to flow through the rail connection of the present invention as shown in FIG. 6. In this cycle, the piston 150 is urged downwards with the oil biasing of the spring 156 as shown in FIG. 6. During the first piston stroke "a" the nipple 154 is still in the bore 146 of the barrel section 144 so that the oil flow is throttled by a gap 162 between the nipple 154 and the bore 146 (FIG. 6), thus providing a pilot injection as described below. In FIG. 7, the piston 150 moves through stroke "b" and opens the full flow area. Between two injection events, the piston 150 is urged back to the initial position via the spring 156, as shown partly in FIG. 8. The working fluid above the piston 150, which may be trapped partially within the annular groove 149*a*, may flow through the bore 150*a* in the top of the piston 150 to the lower side of the piston 150, out holes 160, and to rail connection outlet 142.

Figure 9:
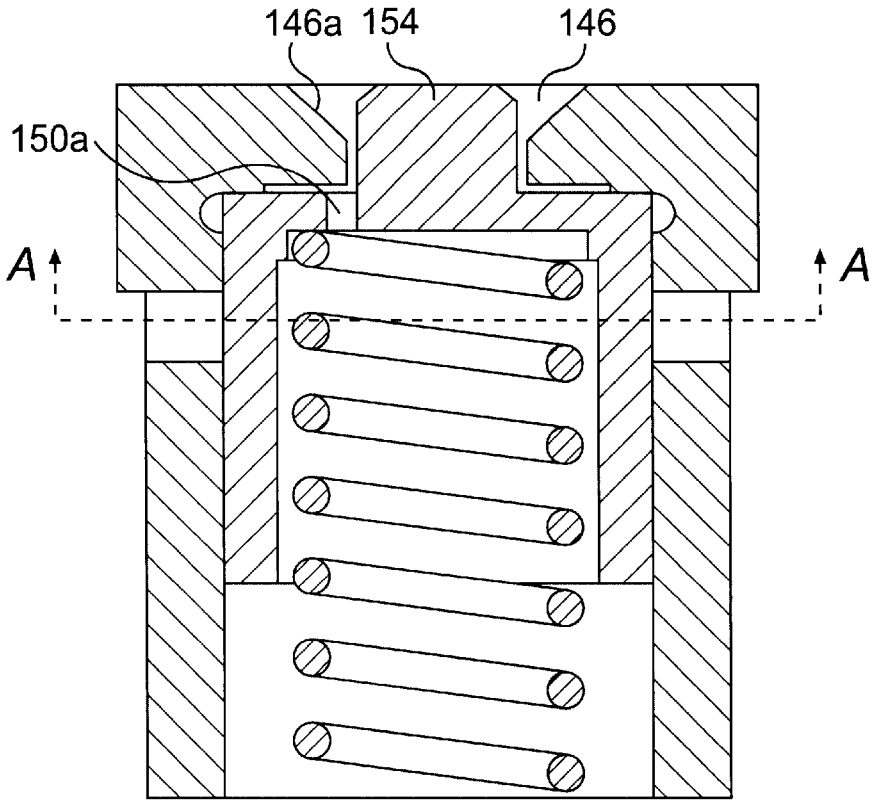
FIG. 9 shows different lateral groove designs used with the rail connection of the present invention.
Figure 10:
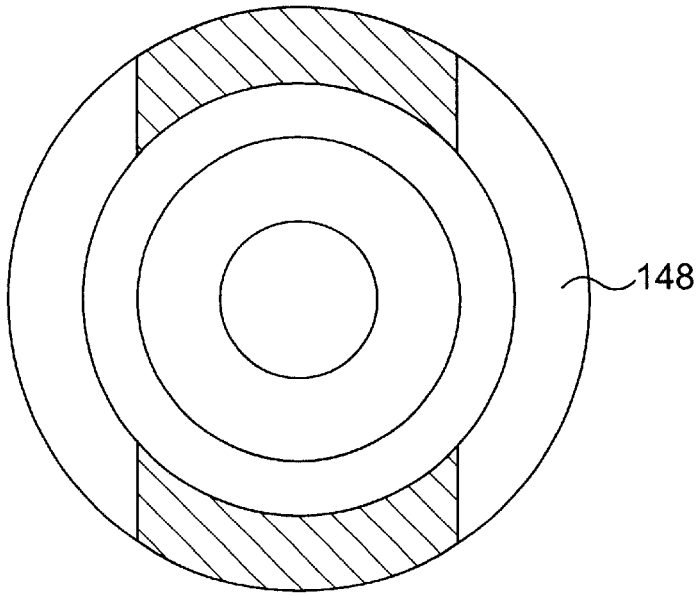
FIG. 10 shows different lateral groove designs used with the rail connection of the present invention.

FIGS. 9 and 10 show different lateral groove designs. In FIGS. 9 and 10, the lateral grooves 148 are evenly spaced on opposing sides of the interior wall of the barrel section 144. However, it should be understood by those of ordinary skill in the art that other groove designs may also equally be used with the present invention.

Figure 11:
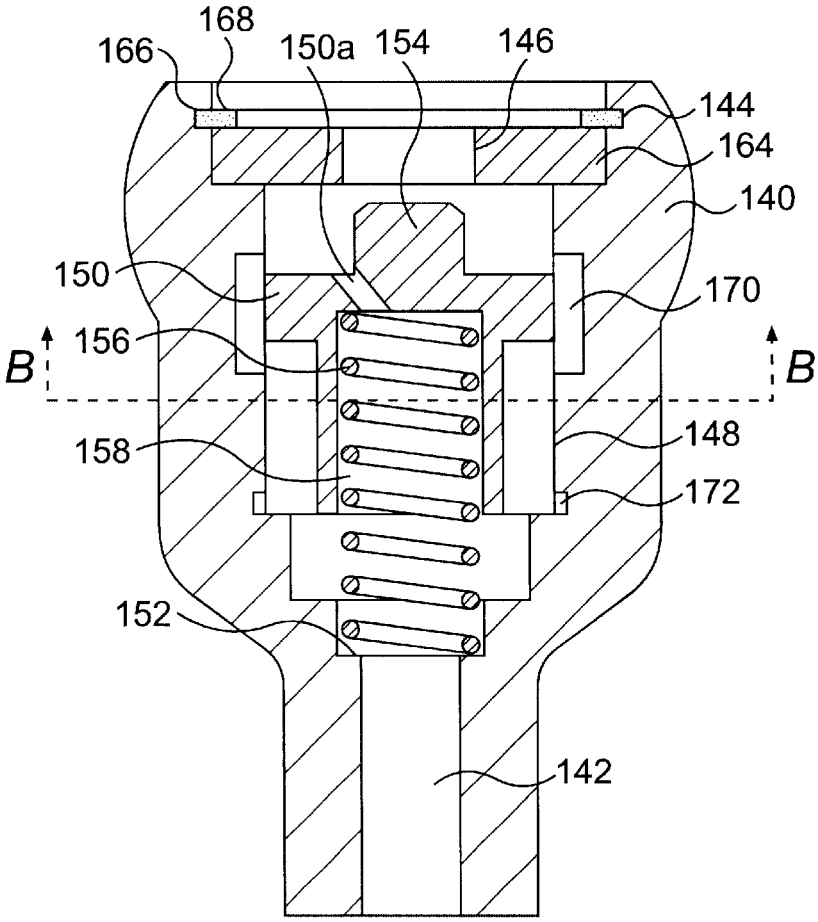
FIG. 11 shows another embodiment of the rail connection of the present invention.
Figure 12:
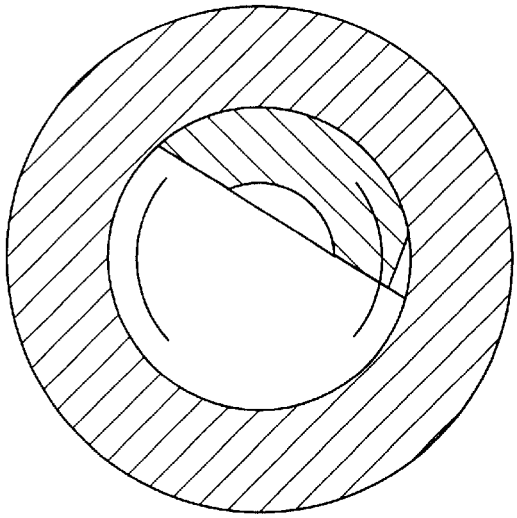
FIG. 12 shows the embodiment of the rail connection of FIG. 11.

FIGS. 11 and 12 show another embodiment of the present invention. In this embodiment, the barrel section 144 is a disk-like member having the centrally located bore 146. The disk-like member 144 rests on a shoulder 164 of the rail connection tube 140. A groove 166 is formed in the upper end of the rail connection tube 140 such that a locking ring 168 can lock the disk 144 to the rail connection tube 140. The nipple 154 of the piston 150 is capable of extending through the centrally located bore 146. The rail connection tube 140 additionally includes the spring seat 152. The spring 156 is positioned within the piston bore 158 between the spring seat 152 of the rail connection tube 140 and a top portion of the piston 150. Lateral grooves 148 are also provided in the rail connection tube 140. Annular grooves 170 and 172 may also be formed in the rail connection tube 140, preferably within the stroke distance of the piston 150. In the embodiment of FIGS. 10 and 11, the rail connection outlet 142 is positioned below the spring seat 152.

Figure 13:
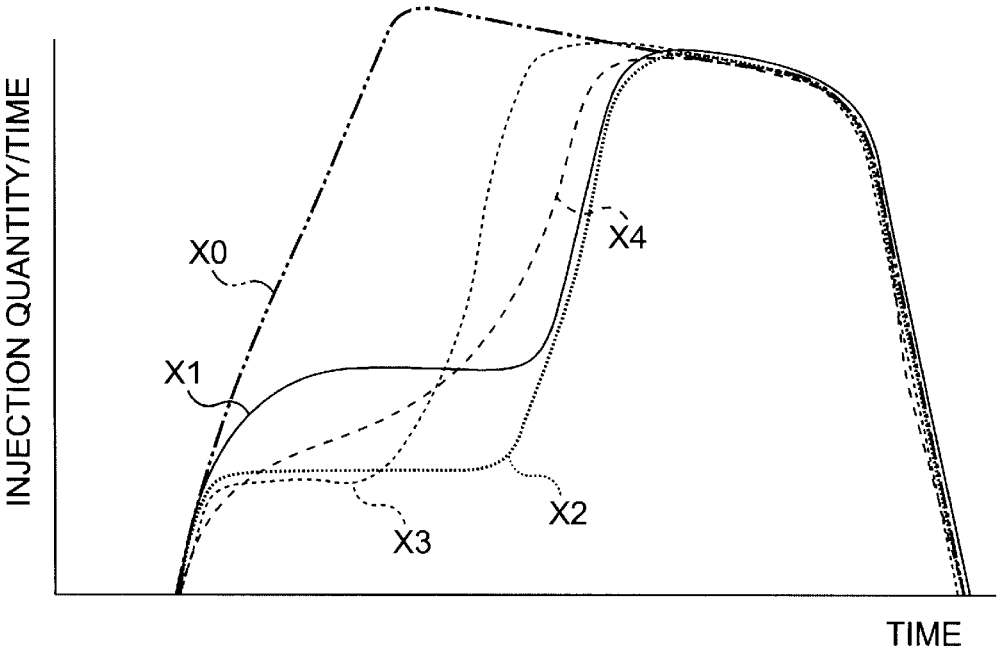
FIG. 13 is a graph of the injection quantity/time versus time for a fuel injector.

FIG. 13 shows a diagram of the injection quantity/time versus time for a fuel injector using the nipple configurations shown in FIGS. 3*a*–3*d*, of the present invention. FIG. 13 further shows the injection quantity/time versus time for a fuel injector using a conventional rail connection designated as $X_0$. As seen in FIG. 13, the nipple configurations of FIGS. 3*a*–3*d* ($X_1$ to $X_4$) implemented with the rail connection of the present invention are designed to allow a small or pilot quantity of fuel to be injected into the combustion chamber of an engine during the initial pre-stroke phase of the fuel injector (e.g., FIG. 6). Comparatively, however, a fuel injector using the configuration of a conventional rail connection $X_0$ initially allows a quantitatively larger amount of fuel to be injected into the combustion chamber of the engine. This leads to fuel inefficiency, higher noise levels, bouncing effects of the control valve and many other shortcomings as described above.

Operation of the Oil Activated Fuel Injector of the Present Invention

In operation, an injector valve opens, and high pressure working fluid (e.g., engine oil) flows through rail connection 114 from a reservoir. Piston 150 is urged downwards, with the force of the oil compressing spring 156. During a first piston stoke "a" corresponding to a pilot injection, nipple 154 will remain partially in the bore 146, such that oil is throttled through gap 162 and into annular groove 149*a*. It can then flow through bore 150*a* into piston bore 158, through holes 160, and finally into rail connection outlet 142 and inlet area 110.

A driver (not shown) will energize the open coil 122. The energized open coil 122 will then shift the spool 118 from a start position to an open position. In the open position, the grooves 116 of the control valve body 102 will become aligned with the grooves 120 on the spool 118. The alignment of the grooves 116 and 120 will allow the initial pressurized working fluid to flow from the inlet area 110 to the working ports 112 of the control valve body 102.

Once the pressurized working fluid is allowed to flow into the working ports 112 it begins to act on the piston and plunger assembly 126. That is, the pressurized working fluid will begin to push the piston and plunger assembly 126 downwards, thus compressing the intensifier spring 127. As the piston and plunger assembly 126 is pushed downward, fuel in the high pressure chamber 130 will begin to be compressed via the end portion 126*a* of the plunger. Due to the small stroke of piston and plunger assembly 126, only a small quantity of compressed fuel will be forced through a throttle into the chamber 133, which surrounds the needle 132. During this pre-stroke cycle, which corresponds to stroke "a" of piston 150, a pilot quantity of fuel is injected into the engine, thus reducing emissions, engine noise, and bounce effect.

As piston 150 continues through stroke "b," grooves 148 are opened to a higher volume oil flow. This additional oil flow travels through grooves 148, into piston bore 158, through holes 160, and finally into rail connection outlet 142 and inlet area 110.

As the pressure increases, the piston and plunger assembly 126 will be pushed further downward, such that a main injection fuel quantity in the high pressure chamber will be forced through the bore 128. The fuel will then flow into the chamber 133 surrounding the needle 132. As the pressure increases, the fuel pressure will rise above a needle check valve opening pressure, such that the needle spring 136 is compressed upwards. At this stage, the injection holes are opened in the nozzle 106, thus allowing a main fuel quantity to be injected into the combustion chamber of the engine.

To end the injection cycle, the driver will energize the closed coil 124. The magnetic force generated in the closed coil 124 will then shift the spool 118 into the closed or start position, which, in turn, will close the working ports 112 of the control valve body 102. That is, the grooves 116 and 120 will no longer be in alignment, thus interrupting the flow of working fluid from the inlet area 110 to the working ports 112. Thus, the biasing force of the needle spring 136 will urge the needle 132 downward towards the injection holes of the nozzle 106, thereby closing the injection holes. Similarly, the intensifier spring 127 urges the plunger and piston assembly 126 into the closed or first position adjacent to the valve control body 102. As the plunger and piston assembly 126 moves upward, a pressure release hole will release pressure in the high pressure chamber 130, allowing fuel to flow into the high pressure chamber 130 via the fuel inlet check valve 134. In the next cycle, this fuel can be compressed in the high pressure chamber 130. As the plunger and piston assembly 126 move towards the valve control body 102, the working fluid returns to a reservoir via the rail system.

As the flow of working fluid through rail connection 114 stops between injection events, piston 150 is urged back to the initial position against upper stop 149 by the biasing force of spring 156. As piston 150 travels upwards, grooves 148 are closed to oil flow. Any oil remaining above piston 150, for example, in annular groove 149*a*, flows through bore 150*a* and into inlet area 110 as described above.

While the invention has been described in terms of preferred embodiments, those skilled in the art will recognize that the invention can be practiced with modification within the spirit and scope of the appended claims.

What is claimed is:

1. A rail connection assembly, comprising:

an outer rail connection tube having a rail connection outlet;

a component having a substantially centrally located bore, said component being fixed to said outer rail connection tube remote from said rail connection outlet;

a piston adapted for movement between a first position and a second position, said second position being remote from said bore;

a nipple having a predetermined cross section and extending from said piston, said nipple being slidably movable into and remote from said bore when said piston is moved between said first and second positions, respectively; and a fluid communication path between said bore and said rail connection outlet.

2. The rail connection assembly according to claim 1, further comprising a gap formable between said nipple and said bore when said piston is moved into an intermediate position between said first and second positions.

3. The rail connection assembly according to claim 1, wherein said fluid communication path is at least one lateral groove formed in said component.

4. The rail connection assembly according to claim 3, wherein said at least one lateral groove is at least two lateral grooves.

5. The rail connection assembly according to claim 4, wherein said at least two grooves is at least four lateral grooves.

6. The rail connection assembly according to claim 3, wherein said lateral grooves are substantially semi-circular.

7. The rail connection assembly according to claim 3, wherein said lateral grooves provide fluid communication between said bore and said rail connection outlet when said piston is moved between said first and second positions.

8. The rail connection assembly according to claim 1, wherein said component is a barrel section.

9. The rail connection assembly according to claim 8, wherein said barrel section is disposed at least partially within said outer rail connection tube.

10. The rail connection assembly according to claim 1, wherein said component is a disk member.

11. The rail connection assembly according to claim 10, wherein said disk member is affixed to said outer rail connection tube via a locking ring.

12. The rail connection assembly according to clam 1, further comprising an annular groove formed in one of said component and said outer rail connection tube.

13. The rail connection assembly according to claim 12, wherein said fluid communication path is at least one lateral groove and wherein said annular groove is positioned such that a portion of said piston overlaps said annular groove when said piston is in said first position and said annular groove is in fluid communication with said at least one lateral groove when said piston is in said second position.

14. The rail connection assembly according to claim 1, wherein said fluid communication path is an annular groove formed in said outer rail connection tube that provides fluid communication between said bore and said rail connection outlet when said piston is moved to said second position.

15. The rail connection assembly according to claim 1, wherein said piston further includes a bore disposed proximate said nipple.

16. The rail connection assembly according to claim 15, wherein said bore disposed proximate said nipple is in fluid communication with said rail connection outlet.

17. The rail connection assembly according to claim 1, wherein said piston further comprises a central bore.

18. The rail connection assembly according to claim 17, wherein one of said piston and said outer rail connection tube further comprises a spring seat disposed remote from said nipple.

19. The rail connection assembly according to claim 18, wherein said spring seat further comprises a plurality of holes in fluid communication with said rail connection outlet.

20. The rail connection assembly according to claim 18, further comprising a spring disposed within said central bore and resting on said spring seat.

21. The rail connection assembly according to claim 1, further comprising an upper stop at said first position of said piston.

22. The rail connection assembly according to claim 1, wherein said bore further comprises flared portions.

23. The rail connection assembly according to claim 1, wherein said rail connection assembly provides a pilot injection of a fuel upon movement of said piston into an intermediate position between said first and second positions and a main injection of the fuel upon movement of said piston into said second position.

24. A rail connection assembly, comprising:

an outer rail connection tube having a rail connection outlet;

a component having a substantially centrally located bore, said component being fixed to said outer rail connection tube remote from said rail connection outlet;

a piston adapted for movement between a first position and a second position, said second position being remote from said bore, said piston including a spring tending to bias said piston towards said first position;

a nipple having a predetermined cross section and extending from said piston, said nipple being slidably movable into said bore when said piston is biased by said spring into said first position; and at least one fluid communication path between said bore and said rail connection outlet formed in one of said outer rail connection tube and said component.

25. The rail connection assembly according to claim 24, wherein said piston further comprises a bore disposed proximate said nipple, said bore disposed proximate said nipple being in fluid communication with said rail connection outlet.

26. The rail connection system according to claim 24, wherein said fluid communication path is a plurality of lateral grooves.

27. The rail connection system according to claim 24, wherein said fluid communication path is an annular groove about said component.

28. The rail connection system according to claim 27, wherein said annular groove is positioned such that a portion of said piston overlaps said annular groove when said piston is in said first position and said annular groove is in fluid communication with said rail connection outlet when said piston is in said second position.

29. A fuel injector system, comprising:

a fuel injector including a control body having an inlet port; and a rail connection assembly, said rail connection assembly comprising:

an outer rail connection tube having a rail connection outlet in fluid communication with said inlet port;

a component having a substantially centrally located bore, said component being fixed to said outer rail connection tube remote from said rail connection outlet;

a piston adapted for movement between a first position and a second position, said second position being remote from said bore;

a nipple having a predetermined cross section and extending from said piston, said nipple being slidably movable into and remote from said bore when said piston is moved between said first and second positions, respectively; and a fluid communication path between said bore and said rail connection outlet.

30. The fuel injector system according to claim 29, wherein said rail connection assembly provides a pilot injection of a fuel when said piston is moved into an intermediate position between said first and second positions and a main injection of the fuel when said piston is moved into said second position.

31. A method of actuating a fuel injector, said method comprising the steps of:

allowing a first amount of working fluid to bias a piston assembly to an intermediate position between a first position and a second position thereby creating a first gap;

allowing the first amount of working fluid to flow through the first gap and into a working fluid inlet of the fuel injector in order to trigger a pilot injection of fuel in the fuel injector during a pre-stroke injection cycle of the fuel injector;

allowing a second amount of working fluid greater than the first amount of working fluid to fully bias the piston assembly into a second position thereby creating a second gap larger than the first gap; and allowing the full amount of working fluid to flow through the second gap and into the working fluid inlet of the fuel injector in order to trigger a main injection cycle of the fuel injector.

* * * * *